United States Patent [19]

Cotton

[11] 3,970,342

[45] July 20, 1976

[54] TIRE SERVICING APPARATUS

[75] Inventor: Larry G. Cotton, Clear Lake, Iowa

[73] Assignee: Iowa Mold Tooling Co., Inc., Garner, Iowa

[22] Filed: June 6, 1975

[21] Appl. No.: 584,588

[52] U.S. Cl. ..... 294/86 R; 157/1.21; 214/333; 214/652; 294/74; 294/88

[51] Int. Cl.² ..... B66C 1/16

[58] Field of Search ..... 294/67 R, 67 B, 67 BA, 294/67 BB, 67 E, 67 EA, 74, 86 R, 88, 111; 157/1.2, 1.21, 1.26; 214/147 R, 147 G, 330–333, 650 R, 651–654, 620; 254/50.1–50.4; 280/179 R, 179 A

[56] References Cited

UNITED STATES PATENTS

| | | | |
|---|---|---|---|
| 3,154,206 | 10/1964 | Gillette et al. | 214/330 |
| 3,578,059 | 5/1971 | Uhen et al. | 157/1.21 |
| 3,830,388 | 8/1974 | Mott | 214/333 |
| 3,858,735 | 1/1975 | Zrostlik | 294/86 R X |

*Primary Examiner*—Evon C. Blunk
*Assistant Examiner*—Johnny D. Cherry
*Attorney, Agent, or Firm*—Wegner, Stellman, McCord, Wiles & Wood

[57] ABSTRACT

Tire servicing apparatus including a tire gripping tool base adapted to be mounted on a vehicle, a crane boom or the like. The base movably mounts a pair of opposed tire gripping members which may be moved towards and away from each other to grip or release a tire for servicing purposes. Hydraulic cylinders are provided for moving the tire gripping members relative to the base and an elongated flexible strap is operatively connected to both of the tire gripping members and has a length sufficient to define a loop of a size to be circumferentially received about a tire. When the loop is so disposed, the motors may be operated to move the tire gripping members away from each other to diminish the size of the loop in the strap to squeeze the tire about its tread thereby seating the beads of the tire on a rim associated therewith.

8 Claims, 2 Drawing Figures

TIRE SERVICING APPARATUS

BACKGROUND OF THE INVENTION

This invention relates to tire servicing apparatus, and, more particularly, tire servicing apparatus for servicing extremely large tires such as those employed in farm tractors, off-the-road trucks, mining equipment, etc.

Prior art of possible relevance includes the commonly assigned Zrostlik U.S. Pat. No. 3,858,735 and U.S. Pat. No. 3,334,864 to Strang et al.

Recent years have been a substantial increase in the size of various off-the-road vehicles of the type generally employed in construction or mining operations as, for example, of-the-road high capacity trucks. Moreover, other vehicles, such as farm tractors are increasingly being made in larger sizes. As the size of such vehicles has been increased, it has also been necessary to increase the size of the tires employed on such vehicles to provide the capability for carrying increased loads. As a result, there are vehicles in existence which are provided with pneumatic tires having diameters well in excess of six feet and weighing several thousand pounds.

Such tires, as any other type of tire, require servicing, but due to their bulk and weight, a great deal of effort is required. Consequently, there have evolved proposals for a variety of tire gripping and manipulating equipment for handling such tires during servicing. Representative of such proposals is the above identified Zrostlik patent and the commonly assigned application of Zrostlik, Ser. No. 351,776, entitled "Tire Changing Apparatus" and filed Apr. 16, 1973, now U.S. Pat. No. 3,927,778.

In addition, through improved tire manufacturing techniques, the size of tubeless tire is also being progressively increased to the point where tubeless tires of a size readily adaptable to servicing with apparatus such as described in the above identified Zrostlike patent and patent application are available.

One typical difficulty encountered with the servicing of tubeless tires of any size is the seating of the beads on the rim. Tubeless tires cannot be inflated until bead seating occurs for the reason that air introduced through a valve stem or the like will escape between the bead and the rim if the beads are not seated thereon.

While there have been many proposals of bead seating equipment for use in seating the beads of tubeless tires of small sizes, such as those typically found on passenger cars, satisfactory and economical means for seating the beads of relatively large tubeless tires have generally been absent from the marketplace.

SUMMARY OF THE INVENTION

It is the principal object of the invention to provide a new and improved tire servicing apparatus. More specifically, it is an object of the invention to provide a tire servicing apparatus which is capable of both manipulating large tires for servicing purposes and for seating the beads of such tires.

The exemplary embodiment of the invention achieves the foregoing object in a structure including a tire gripping fixture having a base which is adapted to be mounted on a vehicle, a crane boom, or the like. A pair of opposed tire gripping members are movably mounted on the base for movement towards and away from each othr so that a tire may be gripped or released, as desired, for the usual servicing purposes as, for example, removing or replacing the tire on a vehicle, transporting the tire from one location to another, etc. Motors are provided for moving the tire gripping members towards and away from each other for gripping or releasing the tire.

An enlongated flexible strap is operatively connected to both the tire gripping members. The strap has a length sufficient to define a loop sized to be circumferentially disposed about a tire. Thus, when a loop is so disposed, the tire gripping members can be moved away from each other by the motors to squeeze the tread on the tire to force the beads thereof into seating engagement with the rim on which the tire may be disposed.

In a highly preferred embodiment, means engaging the strap are located intermediate the gripping members for facilitating the maintenance of the loop. Preferably, such means comprise a double sheave block.

A highly preferred embodiment also includes means for adjusting the effective length of the strap to accommodate tires of varying sizes. The adjusting means will preferably comprise readily releasable, adjustable, cooperating securing elements on the ends of the strap and on either the tire gripping members or the base, with the base being a preferred location.

In addition, a highly preferred embodiment will include a pair of sheaves, one on each tire gripping member with opposite ends of the straps being trained about the sheaves to be adjustably and readily releasably secured to the base.

Other objects and advantages will become apparent from the following specification taken in connection with the accompanying drawings.

DESCRIPTION OF THE PREFERRED EMBODIMENT

Figure 1:
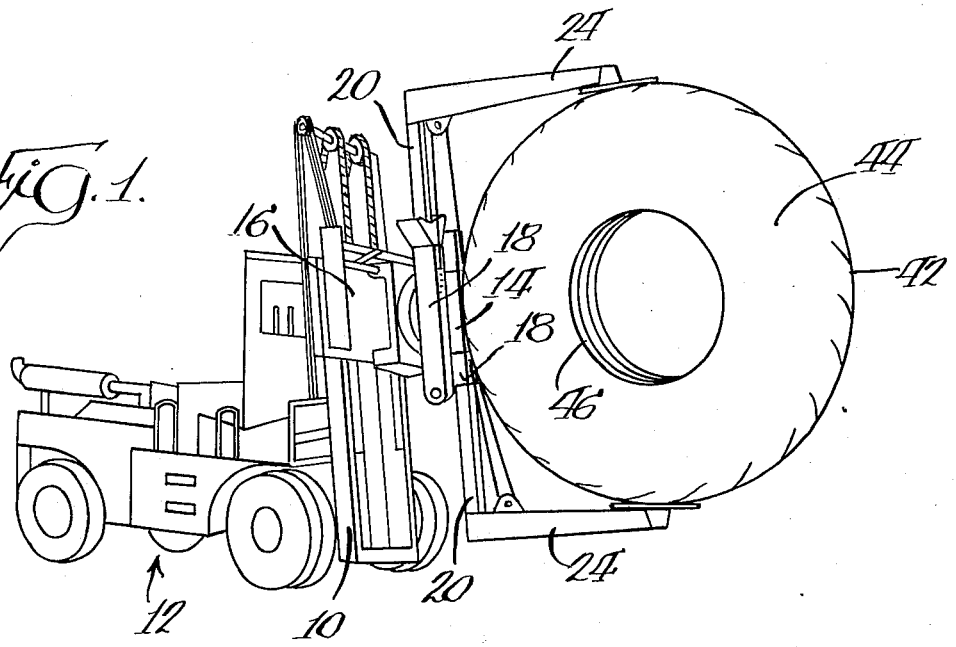
FIG. 1 is a perspective view of tire servicing apparatus made according to the invention disposed on a vehicle, namely, a forklift truck.

An exemplary embodiment of a tire servicing apparatus made according to the invention is illustrated in FIG. 1 as being mounted on the lift boom 10 of a forklift truck 12. However, it is to be understood that the tire servicing apparatus could be mounted on vehicles of other sorts, such as front end loaders or on the ends of crane booms.

The tire servicing apparatus of the invention is mounted on the boom 10 for vertical movement thereon in a conventional fashion. Moreover, it will be recognized that the attitude of the boom 10 relative to the truck 12 may be varied about a horizontal axis with the consequence that the tire servicing apparatus may be raised and lowered and pivoted fore and aft relative to the truck 12.

The tire servicing apparatus includes a base 14 which preferably is mounted for rotation about a generally horizontal axis by means (not shown) to a vertically movable member 16 mounted on the boom 10. For details of such a connection, reference may be had to, for example, the previously identified Zrostlike patent or patent application, the details of both of which are herein incorporated by reference. As a consequence, the tire mounting apparatus may also be rotated as, for example, the purpose of aligning lug bolt holes in a rim with lug bolts on a vehicle.

The base 14, on opposite sides of the pivotal axis of the pivotal connection to the member 16 mounts elongated tubes 18, which are rectangular in cross section. Each tube 18 telescopingly receives one leg 20 of an L-shaped, tire gripping member 22. The remaining leg 24 of each tire gripping member 22 is provided with a tire gripping plate 26 near its end opposite from that connected to the leg 20.

According to a preferred embodiment, the legs 20 will be formed of tubes having a rectangular cross section. Within the tubes 18 and 20, there is located a double-acting, hydraulic cylinder 28 having an end pivotally connected as at 30 to the tube 18 and a rod 32 pivotally connected as at 34 to the associated tire gripping member 22. Consequently, operation of the cylinders 28 through any suitable conventional control can be employed to move the tire gripping members 22 towards and away from each other to grip or release a tire.

For further details of the interrelationship of the tubes 18 and the tire gripping members 22, reference may be had to the previously identified Zrostlik application.

Figure 2:
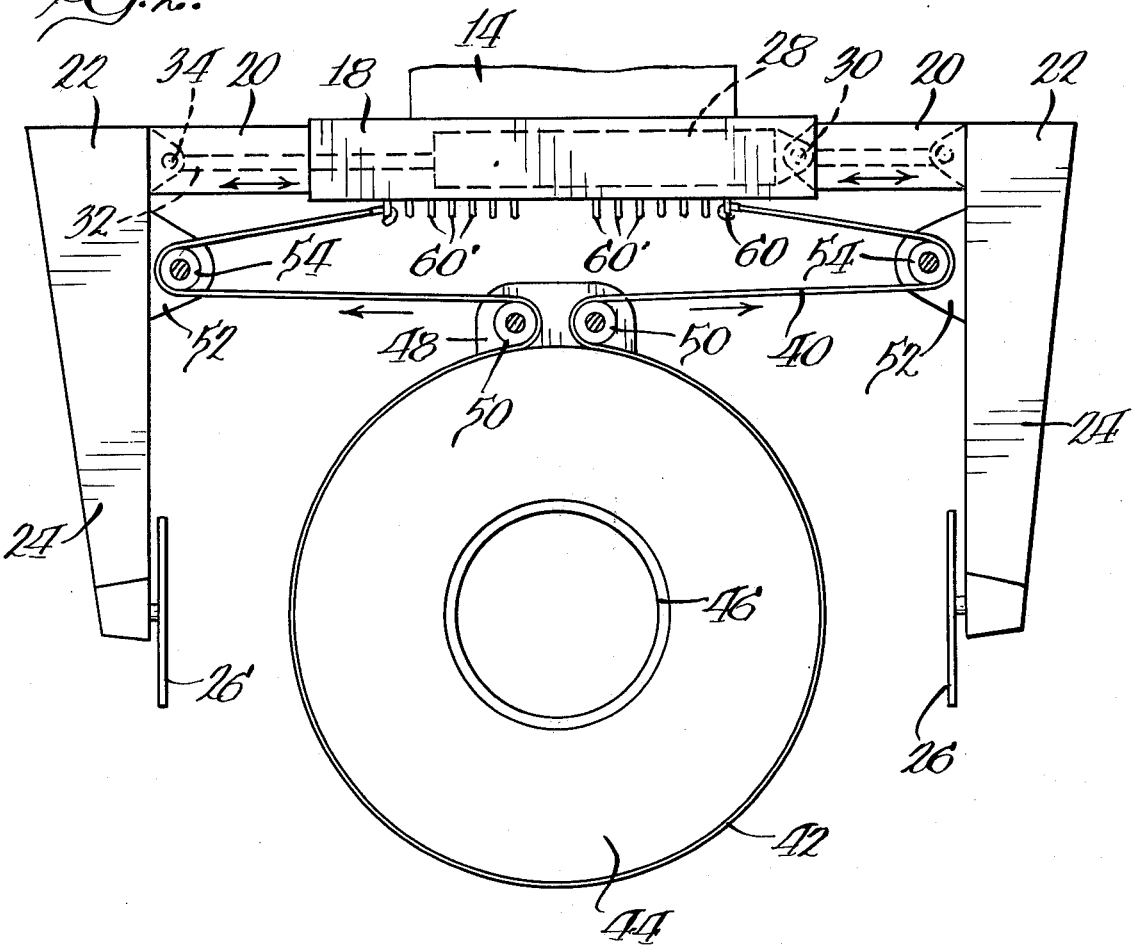
FIG. 2 is an enlarged view of a tire servicing apparatus made according to the invention.

The foregoing structure is capable of performing a variety of tire servicing operations on large tires. In order to render the same capable of bead seating operations, there is provided an elongated, flexible strap 40. The strap 40 is operatively connected to the tire gripping members 22 in a manner to be described in greater detail hereinafter and has a length sufficient to provide a loop 42 of a size sufficient to be circumferentially received about a tire 44, as illustrated in FIG. 2. Consequently, when the tire gripping members 22 are moved away from each other upon actuation of their corresponding cylinders 28, the size of the loop 42 will diminish to squeeze the tire 44 circumferentially to force the beads 46 thereof into seating engagement with a rim (not shown) on which the tire 44 is disposed.

A means 48 is provided for facilitating the maintenance of the loop 42. Preferably, the means 48 is as illustrated in FIG. 2 and takes on the form of a double sheave block whereby the loop 42 is formed by a portion of the strap 40 passing between two sheaves 50.

Each arm 24 of each tire gripping member 22 is provided with mounting tongues 52 for rotatably mounting sheaves 54. The ends of the strap 40 are trained about respective ones of the sheaves 54 and secured to the base 14, specifically, the tubes 18 thereon.

Preferably, the means by which the ends of the strap 40 are secured to the base are readily releasable and adjustable. It is desired that a readily releasable connection be established for the reason that for all tire servicing operations other than bead seating, it will be preferable to remove the strap 40 and the double sheave lock 48 from the apparatus. It is desired that such connections be adjustable for the reason that various size tires can most easily be accommodated during a bead seating operation if the effective length of the strap 40 can be varied.

To the foregoing ends, each end of the strap 40 is provided with a hook 60 which may be received in any one of a series of eyelets 60'' secured to the tubes 18.

It is to be particularly noted that the ends of the strap 40 could be secured to parts of the apparatus other than the base 14 including the tubes 18. For example, the same could be secured to the corresponding tire gripping member 22. However, the arrangement illustrated includng the sheaves 54 is preferred in that for every increment of outward movement of a tire gripping member 22, the circumferential size of the loop 42 will be diminished by twice that amount. Thus, substantial squeezing of the tire 44 about its tread can occur for relatively short increments of movement of the tire gripping members 22.

From the foregoing, it will be appreciated that tire servicing apparatus made according to the invention is economical and expands the functions heretofore performed with similar apparatus. The unique use of the tire gripping members in connection with the strap 40 takes advantage of the already present hydraulic cylinders 28 so that the expense of separate motor means is not required. Similarly, through the unique arrangement of parts in connection with the tire gripping arms, separate apparatus for seating the beads of the tire is not required.

Finally, because the bead seating can occur within the tire servicing fixture provided by the tire gripping members 22, a bead seating operation can be accomplished more efficiently since there is not need to transfer the tire whose beads are to be seated from one apparatus to another solely for the sake of seating the beads. Consequently, handling time is considerably reduced.

I claim:

1. Tire servicing apparatus comprising, a tire gripping tool base adapted to be mounted on a vehicle, a crane boom, or the like;

a pair of opposed tire gripping members movably mounted on said base for movement towards and away from each other whereby a tire may be gripped or released for servicing purposes;

motor means for moving said tire gripping members towards and away from each other; and an elongated, flexible strap operatively connected to both said tire gripping members, said strap having a length sufficient to define a loop of sufficient size to be circumferentially received about a tire;

whereby when said loop is circumferentially disposed about a tire, said motor means may be operated to move said tire gripping members away from each other to diminish the size of said loop thereby squeezing the tire about its tread to seat the beads of the tire on a rim associated therewith.

2. The tire servicing apparatus of claim 1 further including means engaging said strap intermediate said tire gripping members for facilitating the maintenance of said loop.

3. The tire servicing apparatus of claim 2 wherein said facilitating means comprises a double sheave block.

4. The tire servicing apparatus of claim 1 further including means for adjusting the effective length of said strap to accommodate tires of varying sizes.

5. The tire servicing apparatus of claim 4 wherein said adjusting means comprise readily releasable, adjustable, cooperating securing elements on the ends of said strap and on either said tire gripping members or said base.

6. The tire servicing apparatus of claim 1 further including a pair of sheaves, one on each tire gripping member, opposite ends of said strap being trained about said sheaves.

7. The tire servicing apparatus of claim 6 wherein the ends of said strap are secured to said base.

8. The tire servicing apparatus of claim 7 wherein the ends of said strap are secured to said base by readily removable connecting means.

* * * * *